US010619968B2

(12) United States Patent
Culiat

(10) Patent No.: US 10,619,968 B2
(45) Date of Patent: Apr. 14, 2020

(54) PELLET GUN CONVERSION ADAPTER

(71) Applicant: Joshua Culiat, Youngsville, NC (US)

(72) Inventor: Joshua Culiat, Youngsville, NC (US)

(73) Assignee: Joshua Culiat, Youngsville, NC (US)

( * ) Notice: Subject to any disclaimer, the term of this patent is extended or adjusted under 35 U.S.C. 154(b) by 0 days.

(21) Appl. No.: 16/113,708

(22) Filed: Aug. 27, 2018

(65) Prior Publication Data

US 2019/0234704 A1 Aug. 1, 2019

Related U.S. Application Data

(60) Provisional application No. 62/709,768, filed on Jan. 31, 2018.

(51) Int. Cl.
*F41B 11/55* (2013.01)
*F41B 11/681* (2013.01)
*F41B 11/62* (2013.01)

(52) U.S. Cl.
CPC ..... *F41B 11/55* (2013.01); *F41B 11/681* (2013.01); *F41B 11/62* (2013.01)

(58) Field of Classification Search
CPC ..... F41B 11/681; F41B 11/55
USPC ..... 124/72, 58, 71, 75
See application file for complete search history.

(56) References Cited

U.S. PATENT DOCUMENTS 2,061,341 A * 11/1936 Aigner ..... F41A 9/23 124/58
2,110,509 A * 3/1938 Von Latscher-Latka ..... F41B 11/55 124/58
2,251,836 A * 8/1941 Schmidt ..... F41B 11/52 124/58
3,525,319 A * 8/1970 Waldeisen ..... F41B 11/62 124/58
4,280,248 A * 7/1981 Herubel ..... A22B 3/02 124/40
4,644,930 A * 2/1987 Mainhardt ..... F41A 11/02 124/58
5,878,736 A * 3/1999 Lotuaco, III ..... F41B 11/52 124/71

(Continued)

*Primary Examiner* — Joshua E Freeman
*Assistant Examiner* — Bridget A Cochran
(74) *Attorney, Agent, or Firm* — Olive Law Group

(57) ABSTRACT

An apparatus that modularly adapts gas blowback pellet guns to fire pellets from automatic electric gun pellet gun magazines. Embodiments comprise ones that route high-pressure air into a gas frame disposed in a GBB gun magazine well, without tapping either of the gun and the magazine. The apparatus contemplates alternative gas frames, each being at least one having a shape selected from a plurality of shapes adapted to engage the magazine wells of desired GBB guns. The apparatus comprises at least one magazine adapter that is modularly and alternately engageable and disengageable with the gas frame. The apparatus also contemplates alternative adapters, ones that are alternately engageable and disengageable with any of multiple alternative gas frames. The apparatus contemplates embodiments that are alternately disengageable from GBB guns without compromising the gun to receive GBB magazines directly, and ones which allow the HPA source connection to instead receive propulsion sources, comprising pre-compressed gases from a list comprising air reservoirs, compressed CO2 and green gas and other high-pressure gas reservoirs.

16 Claims, 2 Drawing Sheets

(56) References Cited

U.S. PATENT DOCUMENTS 5,924,413 A * 7/1999 Johnson ..... F41B 11/54 124/72
5,954,043 A * 9/1999 Mayville ..... F41B 11/51 124/75
6,024,077 A * 2/2000 Kotsiopoulos ..... F41B 11/724 124/71
6,408,837 B1 * 6/2002 Johnson ..... F41B 11/681 124/51.1
6,708,685 B2 * 3/2004 Masse ..... F41B 11/57 124/75
6,820,608 B2 * 11/2004 Schavone ..... F41B 11/51 124/74
7,159,585 B2 * 1/2007 Quinn ..... F41B 11/723 124/73
7,302,943 B2 * 12/2007 Rice ..... F41B 11/57 124/31
7,861,702 B1 * 1/2011 Sze ..... F41B 11/56 124/73
7,882,830 B1 * 2/2011 Gabrel ..... F41B 11/62 124/73
7,931,018 B1 * 4/2011 Lai ..... F41B 11/721 124/71
7,967,000 B2 * 6/2011 Walker ..... F41B 11/721 124/73
8,033,276 B1 * 10/2011 Gabrel ..... F41B 11/723 124/73
8,051,848 B2 * 11/2011 Maeda ..... F41B 11/62 124/75
8,127,755 B2 * 3/2012 Maeda ..... F41B 11/724 124/74
8,434,465 B2 * 5/2013 Call ..... F41B 11/723 124/71
9,057,578 B2 * 6/2015 Liao ..... F41B 11/55
9,612,081 B2 * 4/2017 Maeda ..... F41B 11/55
9,702,646 B2 * 7/2017 Giaretta ..... F41A 9/83
2003/0047174 A1 * 3/2003 Tiberius ..... F41B 11/51 124/74
2003/0127085 A1 * 7/2003 Brunette ..... F41B 11/55 124/74
2006/0180134 A1 * 8/2006 Illuzzi ..... F41A 9/24 124/74
2006/0283431 A1 * 12/2006 Lee ..... F41A 9/30 124/41.1
2010/0282229 A1 * 11/2010 Tran ..... F41A 9/38 124/71
2011/0041825 A1 * 2/2011 Hu ..... F41A 33/06 124/71
2011/0083653 A1 * 4/2011 Kawashima ..... F41B 11/55 124/57
2011/0146646 A1 * 6/2011 Axelsson ..... F41B 11/62 124/71
2012/0145138 A1 * 6/2012 Dobbins ..... F41A 19/12 124/75
2013/0247890 A1 * 9/2013 Gilley ..... F41B 11/55 124/51.1
2013/0247893 A1 * 9/2013 Yang ..... F41B 11/55 124/74
2015/0176941 A1 * 6/2015 Pullens ..... F41B 11/50 124/45
2015/0211827 A1 * 7/2015 Boza ..... F41B 11/55 29/401.1
2015/0308783 A1 * 10/2015 Lee ..... F41A 33/06 124/71
2016/0123696 A1 * 5/2016 Lai ..... F41B 11/721 124/75

* cited by examiner

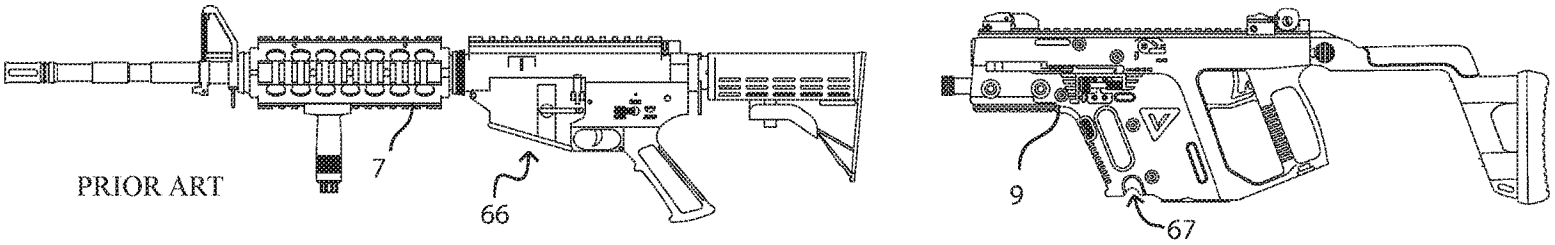
PRIOR ART
FIG. 1
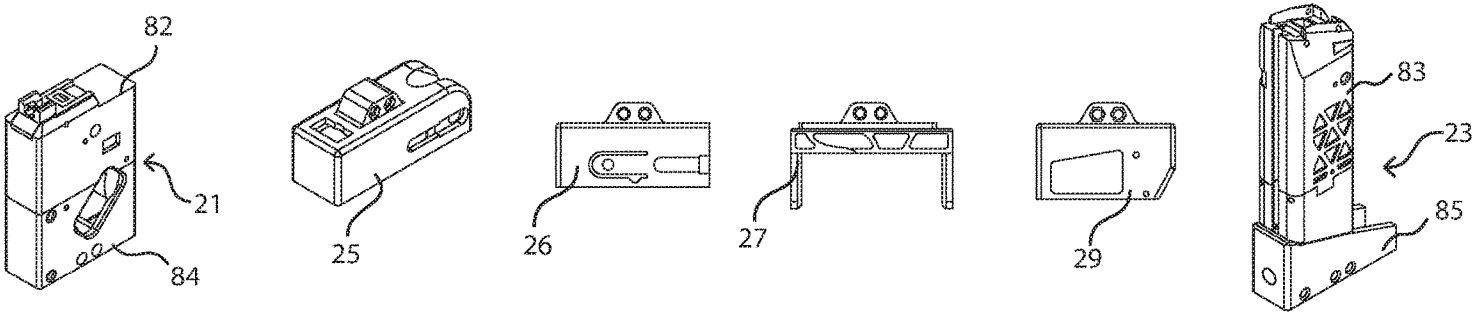
FIG. 2
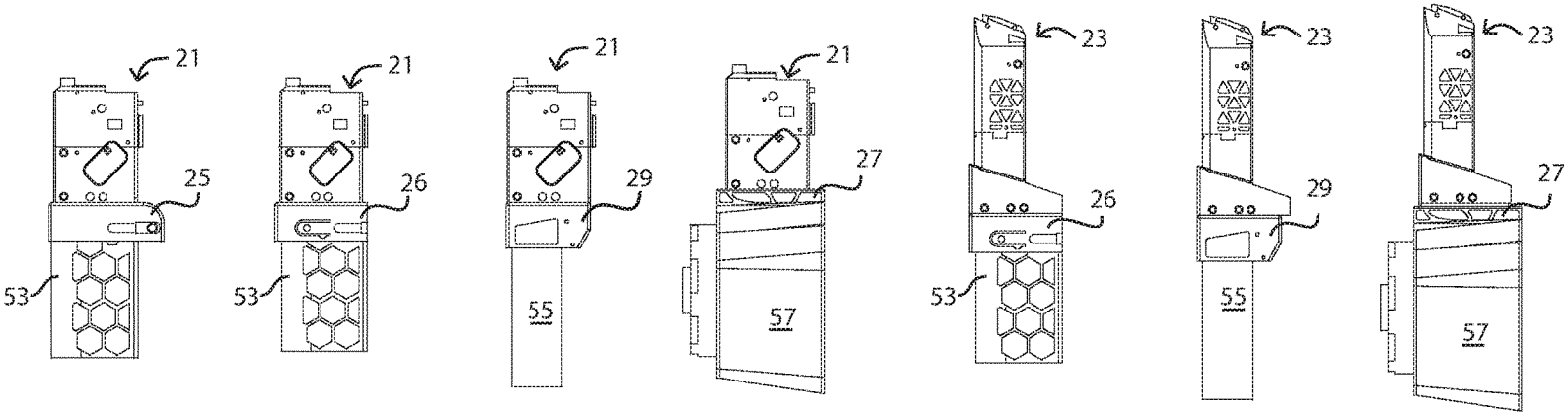
FIG. 3G
FIG. 3F
FIG. 3E
FIG. 3D
FIG. 3C
FIG. 3B
FIG. 3A

PELLET GUN CONVERSION ADAPTER

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

CLAIM TO PRIORITY, PRIOR FILED APPLICATIONS

This application claims the benefit of priority under 35 USC 120, of the following provisional application for patent: "Modular Airsoft Reservoir System", application No. 62/709,768, filed Jan. 31, 2018.

FIELD

The present invention generally relates to gas-propelled Pellet Firing guns, and more specifically pellet gun magazines and high-pressure-air firing mechanisms.

BACKGROUND

It may be appreciated that one problem associated with conventional Pellet Firing gun magazine adapters and high pressure air firing adapters (HPA) is that they are limited to specific guns and magazines and require modification of either Gas Blow Back (GBB) magazines or Automatic Electric Gun magazines, in order to provide either larger capacity or an alternative firing propulsion medium.

In the prior art, there are tools to adapt existing gas magazines between gas blowback and high pressure air, and there are adapters to convert between different sizes of gun-specific magazines, as to AEG guns and GBB guns, separately. However, there has not been an adapter system or apparatus to alternatively allow engagement of alternative pellet capacities, magazine sizes and propulsion sources (nor as to magazines from alternative guns) in order to manage or minimize the detriments of alternative firing and limited options and cost with a single weapon, let alone provide an apparatus which is cross-compatible to provide the same advantages to an alternative weapon, with the same or interchangeable components.

Specifically, each of these design alternatives, and their adapters have their own problems, respectively.

Gas blowback guns suffer from performance degradation. Because of the small gas capacity and small capacity for contained pellet volume, discharging the compressed gas cools the chamber and decreases the firing power, especially with continuous firing. Short distance and speed and rate of firing (shots per unit time) all rapidly decrease, and can even jam or stall the flow of pellets.

Partially because of the desirability of realism in GBB guns, and particularly gas blowback replica rifles (GBBRs), gas blowback guns also have limited capacity, typically 40 shots or fewer. In fact, the GBB magazines are typically internally larger in gas capacity than in volume provided for the BBs/pellets themselves. Lower capacity means that the total number of shots fired during a match, or between reloadings, creates a much higher risk of being ambushed without an opportunity to defend oneself, as well as requiring greater efficiency in per-shot accuracy and effort.

Gas blowback guns also have a much more expensive operating cost. Compressed air/CO2 magazines are expensive, the valving is more complicated and fragile, gas-costs are significantly higher than simply re-loading pellets or simply buying AEG magazines, which are fully mechanical. By contrast, AEG guns provide the space for the propulsion-firing source in the gun itself, rather than in the magazines, so the firing mechanism is contained as part of the more durable part of the assembly. AEGs thereby provide better magazine-to-magazine consistency. GBB guns' performance is limited to the health and condition of each magazine, whereas AEG guns are consistent across all magazines, to whatever degree that the firing mechanism of the gun is reliable.

To minimize costs, GBB guns can be converted to cheaper High Pressure Air (HPA). HPA firing preserves much of the operating satisfaction and GBB firing-behavior, but these generally require routing air/reservoir/compressor gas through a line in a modified GBB magazine, thereby still imposing the capacity limitations of the GBB magazine. Also, as each installation is individually performed for each magazine, inconsistency in quality of assembly may result in inconsistency in gun performance, as well as in magazine-to-magazine reloading and sequentially swapping magazines during use.

There are also several steps required to swap magazines in a GBB gun using HPA-tapped magazines, including: removal of a first magazine, disconnecting the first magazine from the HPA source, connecting a second magazine to the HPA source, and then engaging the second magazine into the gun. These HPA-conversion mechanisms must pass gas into the magazine in the vicinity of where/how the gas reservoirs were arranged within the magazine, and are thereby are compromised in terms of ergonomics, typically requiring that the connection, and pressure line extend downward, from the bottom of the magazine. Geometrically, this means that the overall height of the weapon is significantly larger, particularly in the case of using a GBB magazine with relatively large pellet capacity.

For HPA-magazines which extend the pressure line a significant distance away from the weapon, there are increased odds of it being snagged on clothing or legs during a match, particularly in the case of where the reservoir must be carried in a backpack or other body type of harness, and particularly while running or crouching. This increased height also makes the gun difficult to hold upright and level when laying prone, or close to a surface, such as when hiding from a distant opponent.

Without a need to provide gas reservoirs internally, AEG gun magazines with similar capacity to any particular HPA-converted GBB magazine would have far less downward-extension of the pressure line. However, AEG magazines are not easily adaptable to gas/HPA this way, because both the guns and the magazines lack a direct way to pass gas or air from the magazine into the gun's firing chamber. The firing pressure in an AEG is provided by mechanisms inside the gun. Still, conversion of an AEG to HPA is desirable to those who would like the larger capacity per magazine (or smaller magazine size or form factor, for any particular desired capacity) because the conversion to HPA would allow the AEG to provide a Pellet gun with the bullet-gun-like firing feel of a GBB (or HPA-converted GBB).

To convert an AEG to HPA firing, the gun itself must be tapped, because the shape of a replica rifle is already designed to be held in a particular way with both arms and shoulder and line of sight. Inevitably, the typical installation method for tapping an AEG gun is to tap the underside of the gun, near the handle. This generally does not extend as far downward from the gun as a HPA-converted magazine, but this places a pressure line near the hands, and is closer to the body. It can even more easily be snagged while moving or can compromise posture or adjusting grip, compared to a GBB gun with tapped magazines.

In addition to tapping the gun itself, HPA conversion typically requires replacement of the AEG internal mechanism with an HPA-firing mechanism. This means that the AEG gun can only be operated with an HPA source after the conversion, so there is no availability to remove a pressure line or reservoir, and immediately go back to AEG operation.

Also, it is typical for pellet gun enthusiasts to own more than one gun, and often of completely different style. This means that even if the guns of a single owner are both of the same firing mechanism, the magazines cannot be swapped between the two, rendering duplicate sets of magazines, at double the ownership cost. There is no opportunity to simply use a single cache of magazines that allows all of a user's magazines available to be used with either gun or any other gun.

Therefore, there are several unresolved and persistent needs in the art:

There is a persistent need in the art to provide a solution which allows HPA firing of a pellet gun with rapid swapping and reloading of magazines, provides large capacity and cheaper equipment costs, with bullet-like firing feel and feedback, but with consistent performance, provides a minimal form factor to better facilitate moving and crouching and firing from a low position, and which allows as many magazines as possible to be used, independently of the magazine being originally intended for any particular gun, and which can be used on many different guns, so that the owner does not have to own an apparatus for each gun, and which maintains the ability of the gun to fire as originally designed, with its original magazines and otherwise originally-compatible magazines.

SUMMARY

The present invention provides an apparatus that can be used modularly with respect to many alternative GBB Pellet guns, by providing a gas frame that is adapted to being sized and arranged to engage the magazine wells of dissimilar guns, in the alternative. It also can be used modularly with respect to many alternative AEG Pellet gun magazines, by the gas frame being adapted to engage with alternate adapters that are each adapted to engage with AEG pellet gun magazines of a desired size and shape and capacity. In this way, the apparatus allows for any GBB Pellet gun to use any AEG pellet gun magazine.

Independently of the form factor of the gas frame or adapter engaged to the gas frame, the apparatus is adapted to allow HPA firing by the gas frame being assembled and arranged to receive an HPA pressure source, such as an air pressure line from a remotely-carried air pressure reservoir or compressor, bringing the pressure line into the gun via the well, rather than by a tapped GBB magazine or by tapping an AEG gun itself. Several embodiments run the pressure line into the gas frame at a location which is above the adapter. In such embodiments, the line connector resides inside the gas frame, within the interior of the well, rather than extending below the gun, such that the pressure line can more closely follow the underside of the gun, without having to extend very far vertically below the gun.

The apparatus allows for alternately larger capacity, by AEG magazines providing a greater quantity of pellets than the gun's original GBB magazines, for any given form factor of magazine, and the modular gas frame allows any gun to use an adapter for a magazine that may not even be one of proprietary association with any particular gun or replica.

The apparatus provides rapid swapping and reloading of magazines, because magazines are engageable and swappable in the same way as originally designed for AEG guns, and are unencumbered by connection to a pressure line, because the pressure line enters the gas frame, and the magazine connects to the adapter, the adapter connecting to the gas frame (rather than the pressure line connecting to the magazine). The apparatus also allows rapid swapping and reloading by the entire apparatus being removable from the well of the gun and the resulting empty well being unmodified from its original GBB configuration. The apparatus can simply be removed and a GBB magazine can be inserted, without any other modification or disconnection.

These solutions provide large capacity and cheaper equipment costs, with bullet-like firing feel and feedback, but with consistent performance, provide a minimal form factor to better facilitate moving and crouching and firing from a low position, and allow as many magazines as possible to be used, independently of the magazine being originally intended for any particular gun, and which can be used on many different guns, so that the owner does not have to own an apparatus for each gun.

BRIEF DESCRIPTION OF THE DRAWINGS

The embodiments are illustrated by way of example and not limitation in the figures of the accompanying drawings in which like references indicate similar elements.

FIG. 1 shows a diagram of two gas blowback pellet guns of the prior art.

FIG. 2 shows several magazine adapters set of an exemplary apparatus embodiment of the present invention.

FIG. 3A shows an exemplary assembled gas frame, magazine adapter, and magazine apparatus embodiment of the present invention.

FIG. 3B shows an exemplary assembled gas frame, magazine adapter, and magazine apparatus embodiment of the present invention.

FIG. 3C shows an exemplary assembled gas frame, magazine adapter, and magazine apparatus embodiment of the present invention.

FIG. 3D shows an exemplary assembled gas frame, magazine adapter, and magazine apparatus embodiment of the present invention.

FIG. 3E shows an exemplary assembled gas frame, magazine adapter, and magazine apparatus embodiment of the present invention.

FIG. 3F shows an exemplary assembled gas frame, magazine adapter, and magazine apparatus embodiment of the present invention.

FIG. 3G shows an exemplary assembled gas frame, magazine adapter, and magazine apparatus embodiment of the present invention.

DETAILED DESCRIPTION

Figure 5:
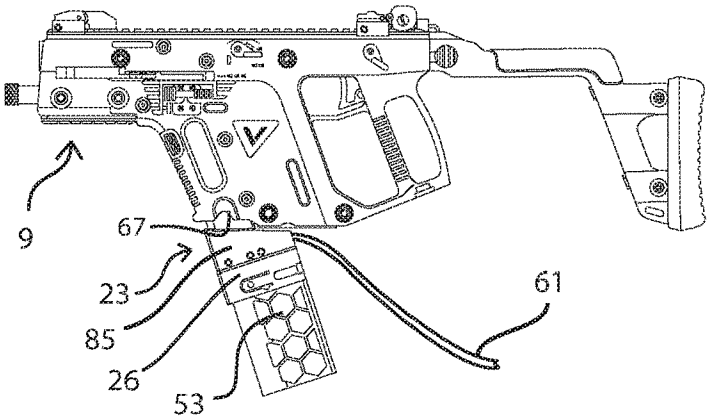
FIG. 5 shows an exemplary assembled apparatus embodiment of the present invention, installed in a gas blowback pellet gun.

The following description and drawings are illustrative and are not to be construed as limiting. Numerous specific details are described to provide a thorough understanding. However, in certain instances, well known or conventional details are not described in order to avoid obscuring the description. References to one or an embodiment in the present disclosure are not necessarily references to the same embodiment; and, such references mean at least one.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

Referring now to FIG. 1, two popular gas blowback ("GBB") BB-pellet-guns are shown. These are an M4/M-16 GBB replica Rifle (7) (hereafter "M4") and an AK-47 GBB replica Rifle (9) (hereafter "AK"). Each of these rifles have several popular alternative magazines, all of which are compatible in particular to the shape of the gun specific to the replica. The guns receive proprietarily sized and shaped magazines into their respective magazine wells (66 and 67). The M4 well 66 is much wider and shallower than the AK well 67.

With respect to each gun, alternative magazines are predominately identical in exterior geometry to the magazines for bullets that are specific to each of the bullet-firing guns that each gun replicates, respectively. Not shown here are the GBB-enabling magazines that are designed to provide pellets to these GBB guns, so that they are able to fire according to their original GBB mode of operation.

Referring now to FIG. 2, what is shown is an exemplary apparatus embodiment of the present invention, comprising several gas frames (21 and 23) and magazine adapters (25, 26, 27, 29). The exemplary M4 frame 21, AK frame 23, quick-connect M4 magazine adapter 25, compact M4 magazine adapter 26, AK magazine adapter 29, and AEG drum magazine adapter 27 are each assembled and arranged to be alternately engageable with one another (as combinations of a gas frame shape and magazine adapter), to provide various parallel and alternative configurations between several existing guns and magazines.

The M4 frame 21 comprises a two-piece construction, an upper section 82 and a midsection 84. The AK frame 23 also comprises a two-piece construction, an upper section 83 and a midsection 85. This two piece construction allows for a single gas frame to support other adapters later, as the field develops, and to allow for potential alternative propulsion sources to be used in the same apparatus, as desired. One contemplated example would be independently removable gas canisters, which may require a longer or differently shaped midsection.

Referring to FIGS. 3A-G, what are shown are exemplary assembled embodiments of several adapters and frames. Each of the embodiments is engaged with a popular but merely exemplary magazine for Automatic Electric Gun (AEG) versions for each of the M4 and AK replica rifles.

The embodiment in FIG. 3A provides an M4 frame 21 with an AEG M4 magazine 53 by using a quick-connect M4 magazine adapter 25.

The embodiment in FIG. 3B provides an M4 frame 21 with an AEG M4 magazine 53 by using a compact M4 magazine adapter 26.

The embodiment in FIG. 3C provides an M4 frame 21 with an AEG AK magazine 55 by using an AK magazine adapter 29.

The embodiment in FIG. 3D provides an M4 frame 21 with a non-proprietary AEG drum magazine 57 by using a drum magazine adapter 27.

The embodiment in FIG. 3E provides an AK frame 23 with an AEG M4 magazine 53 by using a compact M4 magazine adapter 26.

The embodiment in FIG. 3F provides an AK frame 23 with an AEG AK magazine 55 by using an AK magazine adapter 29.

The embodiment in FIG. 3G provides an AK frame 23 with a non-proprietary AEG drum magazine 57 by using a drum magazine adapter 27.

Referring now to FIGS. 4-7 show exemplary alternatively assembled and arranged apparatus embodiments of the present invention, installed in either M4 or AK GBB pellet guns.

Figure 4:
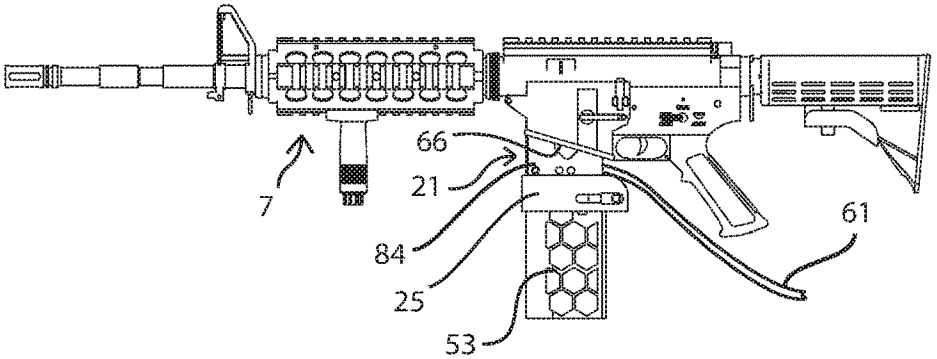
FIG. 4 shows an exemplary assembled apparatus embodiment of the present invention, installed in a gas blowback pellet gun.
Figure 6:
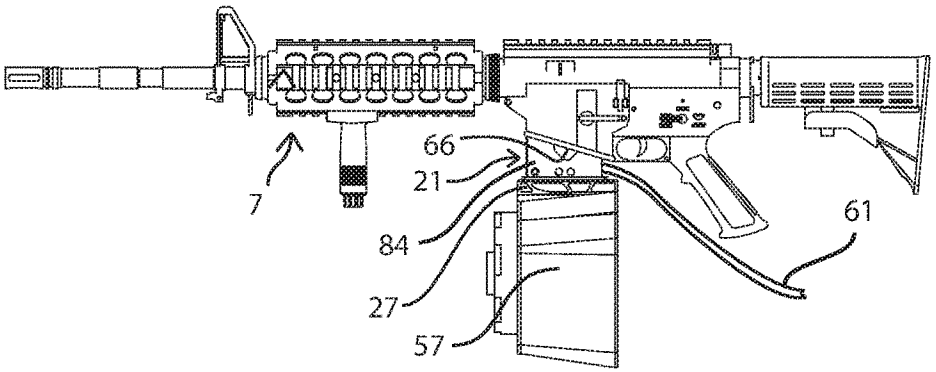
FIG. 6 shows an exemplary assembled apparatus embodiment of the present invention, installed in a gas blowback pellet gun.

FIG. 4 and FIG. 6 show a GBB M4 gun (7), as fitted with apparatus embodiments of the invention inserted in the M4 well 66 that comprises an M4 frame 21, showing the midsection 84, and an HPA pressure line 61 entering the M4 frame 21 from the rear of the midsection 84.

The embodiment in FIG. 4, though, uses a quick connect M4 adapter 25 to connect the midsection 84 to an AEG M4 magazine 53, while the embodiment in FIG. 6 uses a drum adapter 27 to connect the midsection 84 to an AEG drum magazine 57.

Figure 7:
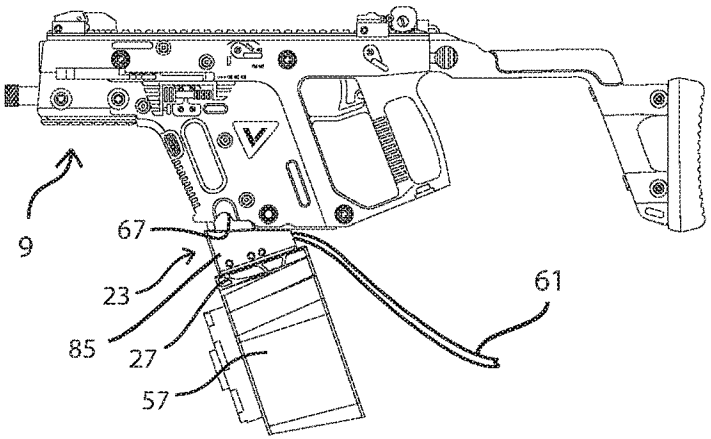
FIG. 7 shows an exemplary assembled apparatus embodiment of the present invention, installed in a gas blowback pellet gun.

FIG. 5 and FIG. 7 show a GBB AK gun (9), as fitted with apparatus embodiments of the invention inserted in the AK well 67 that comprises an AK frame 23, showing the midsection 85, and an HPA pressure line 61 entering the AK frame 23 from the rear of the midsection 85.

The embodiment in FIG. 5, though, uses a compact M4 adapter 26 to connect the midsection 84 to an AEG M4 magazine 53, while the embodiment in FIG. 7 uses a drum adapter 27 to connect the midsection 84 to an AEG drum magazine 57.

In the foregoing specification, the disclosure has been described with reference to specific exemplary embodiments thereof. It will be evident that various modifications may be made thereto without departing from the broader spirit and scope as set forth in the following claims. The specification and drawings are, accordingly, to be regarded in an illustrative sense rather than a restrictive sense.

I claim:

1. An apparatus for gas blowback (GBB) pellet guns having a magazine well, and for magazines of automatic electric gun (AEG) pellet guns, comprising:

a gas frame, and a magazine adapter, the gas frame being configured to engage with the magazine well of a GBB pellet gun, and the magazine adapter being adapted to engage with an automatic electric gun pellet magazine.

2. The apparatus of claim 1, the apparatus being configured to fire pellets contained in the AEG magazine with gas pressure provided to the apparatus from a contained pressurized gas source.

3. The apparatus of claim 2, the apparatus further being configured to alternately disengage a first magazine and engage a second magazine without disconnecting the gas pressure source from the apparatus.

4. The apparatus of claim 2, wherein the gas pressure source is a pressurized gas reservoir that allows for gas blowback firing.

5. The apparatus of claim 2, wherein the gas pressure source is a high-pressure air source.

6. The apparatus of claim 5, wherein the high-pressure air source is a remote high-pressure air source that provides high pressure air to the apparatus by a high-pressure-air line.

7. The apparatus of claim 6, wherein the high-pressure air line enters the apparatus between the adapter and the body of the gun.

8. The apparatus of claim 7, wherein the high-pressure air line enters the apparatus between the adapter and the underside of the gun by the high-pressure air line entering the gas frame.

9. The apparatus of claim 8, wherein the gas frame comprises and upper section and a midsection, the line entering the gas frame by entering the midsection of the gas frame.

10. The apparatus of claim 2, wherein the pressurized gas source is provided to the apparatus by being provided to the gas frame of the apparatus.

11. The apparatus of claim 10, wherein the pressurized gas source is provided to the apparatus without tapping a magazine or tapping the gun.

12. The apparatus of claim 2, wherein the apparatus is alternately removable from the magazine well of the gun, alternately removable by removal of the apparatus, such that the gun can receive in its magazine well gas blowback magazines for the gun and magazines for other GBB guns having magazine wells of similar size and shape, and such that the gun can be fired by GBB firing, without any modification.

13. The apparatus of claim 1, wherein the apparatus is configured to alternately engage and disengage an AEG magazine from of a variety of alternative magazines for the gun and for guns having a particular size and shape of magazine well that is predominantly identical in size and shape to the magazine well of the gun.

14. The apparatus of claim 1, the gun being a first gun, and wherein the apparatus further comprises at least one additional adapter that is configured to engage with an AEG magazine of a second AEG gun, the second gun having a magazine well with a size and shape that is dissimilar to the magazine well of the first gun.

15. The apparatus of claim 1, the gun being a first gun, and further comprising at least one additional adapter configured to engage with an AEG magazine of greater capacity than AEG magazines of AEG versions of the first gun and which is not proprietary to any particular pellet gun.

16. The apparatus of claim 1, the gun being a first gun, and further comprising at least one alternative gas frame that is sized and shaped to engage with the magazine well of a second gun having a magazine well, the magazine well of the second gun being of a dissimilar size and shape to the magazine well of the first gun.

* * * * *